US008650786B2

(12) United States Patent
Trigg et al.

(10) Patent No.: US 8,650,786 B2
(45) Date of Patent: Feb. 18, 2014

(54) CONNECTING DEVICES DISPLAYING INDICIA

(75) Inventors: Larry Trigg, Santa Clara, CA (US); Pamela Chew, Singapore (SG); Peter Gysling, New Plymouth, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1146 days.

(21) Appl. No.: 11/796,905

(22) Filed: Apr. 30, 2007

(65) Prior Publication Data

US 2008/0263920 A1 Oct. 30, 2008

(51) Int. Cl.
*G09F 3/18* (2006.01)

(52) U.S. Cl.
USPC ..... 40/661.11; 40/1.5

(58) Field of Classification Search
USPC ..... 40/721, 799, 793, 777, 661.11, 663; 2/246; 411/515, 511; 24/439
See application file for complete search history.

(56) References Cited

U.S. PATENT DOCUMENTS

| | | | | | |
|---|---|---|---|---|---|
| 1,618,073 | A * | 2/1927 | Flint | 40/661.11 |
| 2,028,740 | A * | 1/1936 | Devine | 428/55 |
| 3,295,236 | A * | 1/1967 | Wishnia | 40/642.02 |
| 3,466,779 | A * | 9/1969 | Zucker et al. | 40/586 |
| 3,645,022 | A * | 2/1972 | Anderson | 40/661.05 |
| 5,495,390 | A * | 2/1996 | Yu | 361/679.37 |
| 6,471,059 | B2 * | 10/2002 | Purvis | 206/459.1 |
| 6,568,044 | B1 * | 5/2003 | Kidd | 24/104 |
| 6,675,512 | B1 * | 1/2004 | Shwartz et al. | 40/329 |
| 6,760,989 | B2 * | 7/2004 | Peterson et al. | 40/593 |
| 7,011,030 | B1 * | 3/2006 | Jans | 112/104 |
| 2003/0177674 | A1 * | 9/2003 | Miller | 40/27.5 |
| 2006/0143790 | A1 * | 7/2006 | Kronenberger | 2/184 |
| 2008/0110071 | A1 * | 5/2008 | Farnsworth et al. | 40/722 |

* cited by examiner

*Primary Examiner* — Kristina Junge

(57) ABSTRACT

Various embodiments are directed to connecting devices that display indicia. A first device displays indicia and affixes to a surface of an object. A second device removable connects to the first device and also displays indicia. The second device is removable from the first device to change which indicia are displayed on the object.

20 Claims, 3 Drawing Sheets

CONNECTING DEVICES DISPLAYING INDICIA

BACKGROUND

Logos are used to identify companies, organizations, products, services, and even locations. Companies use logos as market and identify not only the company, but also specific products and services.

Since a company can sell a variety of products, multiple different types of logos are often used to accommodate the products. Multiple logos are used because different types of products have various textures, sizes, materials, etc. For example, a company that distributes cameras and printers can also distribute product lines of soft goods, such as apparel. In this instance, one type of logo is needed to affix to the hard surface of the printers while another type of logo is needed to affix to the soft surface of the apparel.

Multiple logo attachment methods may be fine aesthetically but result in higher costs due to multiple design, tooling and inventory and can create consistency problems in brands.

DETAILED DESCRIPTION

Exemplary embodiments are directed to apparatus, systems, and methods for logos. One embodiment provides a logo system having a first logo and a second logo that removably attaches to the first logo. The logo system is versatile and attachable to a variety of different product sizes, shapes, and materials.

In one embodiment, the first and second logos are formed of different materials. By way of example, the first logo is formed of a metal or hard plastic, and the second logo is formed of a soft pliable material. Forming the logos from different materials enables the logo system to be affixed to a variety of surfaces and textures, such as hard surfaces (example electronic devices) and soft surfaces (example apparel or soft flexible merchandise).

In one embodiment, the first and second logos are connected together to form a single logo or used separately as two independent logos. When the logos are connected together, the first logo connects on top of the second logo, and the two logos are affixed to the product. When the logos are used separately, each logo is independent affixed to the same or different products.

A single logo system is thus usable with both rigid and non-rigid products. The second logo or backer can be applied to either hard or rigid surfaces and soft or pliable surfaces. For instance, the backer can be stitched to soft products or adhered (example, with an adhesive) to hard surfaces.

The second logo or backer accepts plural different first logos or jewel logs. Each jewel logo can have different sizes, shapes, colors, materials, insignias, etc. For instance, the backer logo can connect to a jewel logo formed of metal or a jewel logo formed of polymer. Each jewel logo can be different to accommodate different product lines of a company.

Figure 1:
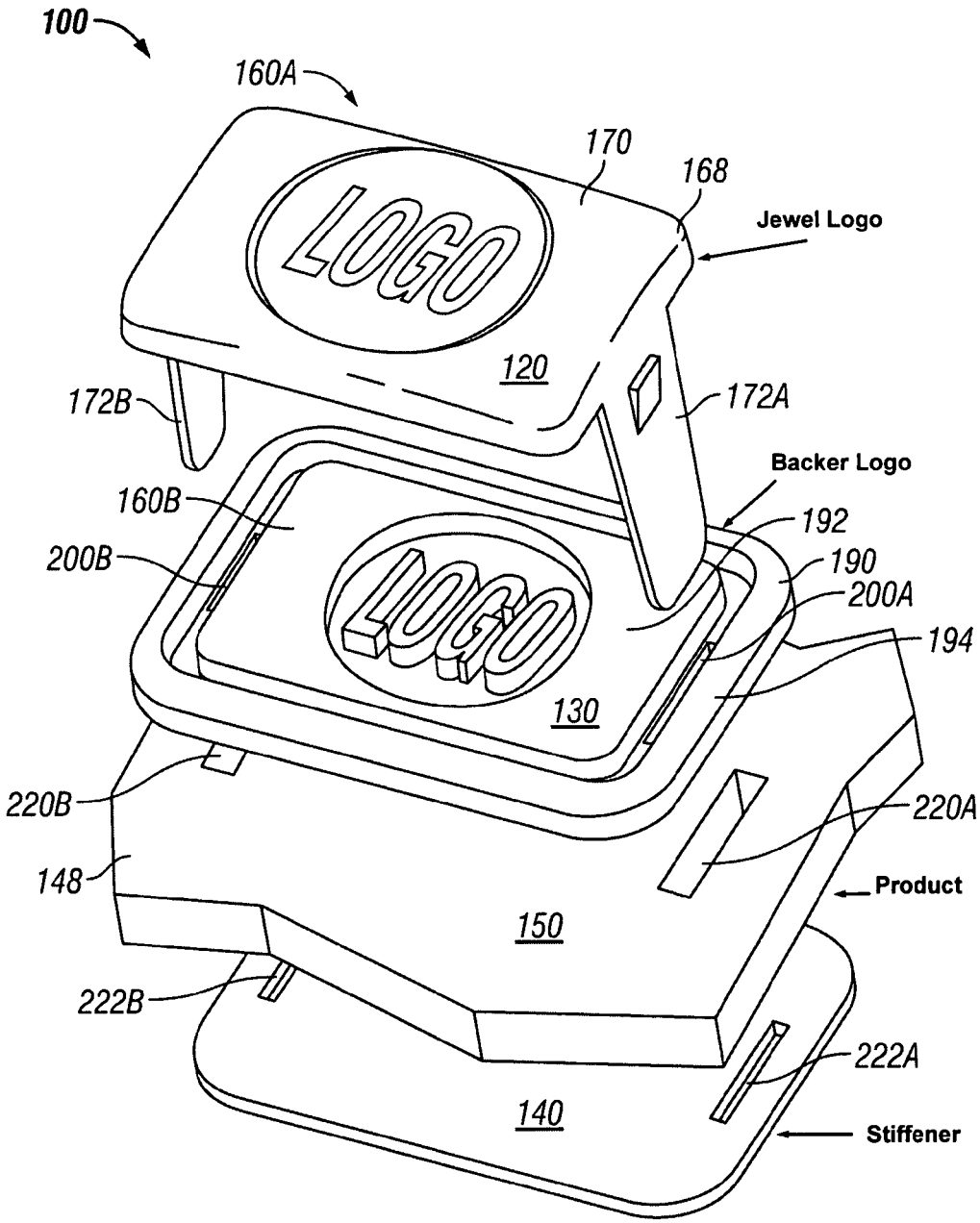
FIG. 1 is an exploded perspective view of a logo system according to one exemplary embodiment.

FIG. 1 is an exploded perspective view of a system 100 (example, a logo system) according to one exemplary embodiment for attaching two objects to a surface, substrate, or other item. For illustration, embodiments are discussed in connection with logos. Although the figures illustrate a logo being placed on a first portable binding device 120 and a second portable binding device 130, exemplary embodiments are not limited to logos but also include other indicia such as, but not limited to, text, graphics, labels, warnings, instructions, etc. As used herein, the word "indicia" means a distinctive mark. In one embodiment, the first and second binding devices 120, 130 are placed or attached to a variety of objects such as, but not limited to, products, surfaces, items, objects, and apparatus.

In one embodiment, the logo system 100 includes a first binding device, logo or jewel logo 120, a second binding device, logo or backer logo 130, and a stiffener or plate 140. The logo system 100 connects to a surface 148 of a product, substrate, or other item 150.

Each of the first and second logos 120, 130 includes a graphic element, symbol, icon, trademark, or logo 160A, 160B. In one embodiment, the logos 160A, 160B are the same or identical, and in one embodiment the logos are different. For instance, the logos 160A, 160B are formed of different materials and/or have different shapes, sizes, colors, etc.

Figure 3:
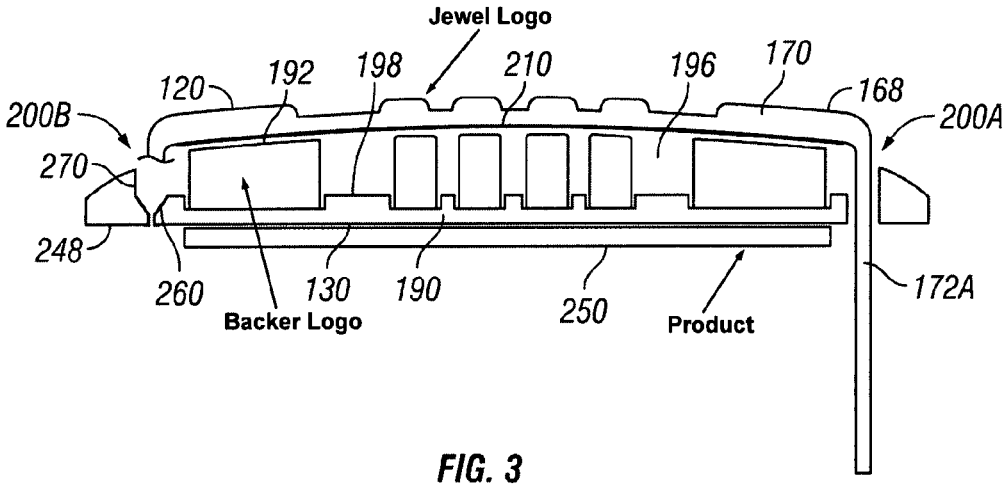
FIG. 3 is a side view of bottom and top portions of a logo system according to one exemplary embodiment.

Looking to FIGS. 1 and 3, the first logo 120 generally includes a body 168 having a top surface 170 with logo 160A. Two elongated tabs 172A, 172B are oppositely disposed and extend downwardly from the body 168. In one exemplary embodiment, the first logo 120 is formed of a hard material, such as metal or polymer.

Figure 2:
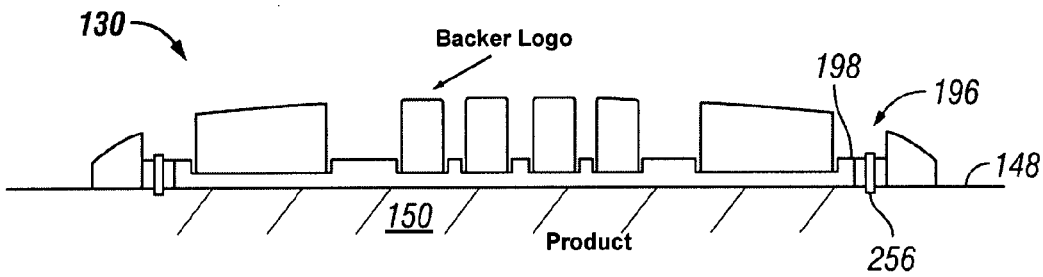
FIG. 2 is a side view of a bottom portion of a logo system according to one exemplary embodiment.

Looking to FIGS. 1-3, the second logo 130 generally includes a body 190 having a top surface 192 with logo 160B. The body includes a shoulder or wall 194 that extends around an outer periphery of the body. A channel or groove 196 extends between the logo 160B and wall 194. This channel 196 includes a bottom surface 198 having oppositely disposed holes or slits 200A, 200B.

The first logo 120 fits on top of the second logo 130 such that tabs 172A, 172B align with respect slits 200A, 200B. The tabs extend through the slits until an underside cavity 210 in the first logo 120 receives and engages with top surface 192. In one embodiment, the size and shape of the cavity 210 matches the size and shape of body 190 having top surface 192.

The logo system 100 connects to a variety of products and surfaces. As shown in FIG. 1, the product 150 has two oppositely disposed holes or slits 220A, 220B. Likewise, the stiffener 140 includes two oppositely disposed holes or slits 222A, 222B. In one embodiment, the first logo 120 fits on top off and connects to the second logo 130 to cover or conceal the logo 160B. Slits 200A/200B, 220A/220B, and 222A/222B align such that the tabs 172A, 172B extend downwardly through the slits to secure the first and second logos 120, 130 to product 150.

Once the first logo 120 is covering the second logo 130, the logo 160B is no longer visible. In this instance, logo 160A is visible on the exterior surface of the product 150. When the first logo 120 is removed, the logo 160B is visible. The first logo 120 can thus be removed from the second logo 130 in order to change which logo 160A or 160B is visible.

The first logo 120 can be used independently (i.e., without the second logo 130). In one embodiment, the first logo 120 fits directly on top off the product 150. For example, an underside or bottom surface of the first logo 120 includes or is provided with an adhesive to adhere to a top surface of the product. As another example, the tabs 172A, 172B extend downwardly through the slits 220A, 220B in the product to secure to the product. As yet another example, the tabs 172A, 172B extend downwardly through the slits 220A, 220B in the product and the slits 222A, 222B in the stiffener 140 to secure to the product.

In one embodiment, the stiffener 140 is formed of a hard, rigid material, such as polymer or metal. The stiffener provides a rigid surface on which to mount the first and/or second logos 120, 130. Further, the stiffener 140 is optional and need not be used in some embodiments.

As shown in FIG. 3, the second logo 130 includes a bottom surface 248 that has an adhesive 250. The adhesive 250 includes a compound to enable the second logo 130 to bond or adhere to the surface 248 of product 150. For instance, when the second logo 130 is used independently without the first logo 120, the second logo uses the adhesive to affix to surface 148 of product 150.

In one embodiment, the second logo 130 is formed of a flexible or pliable material, such as vinyl, rubber, polymer, etc. The flexibility of the second logo enables it to be affixed to either rigid or non-rigid product surfaces.

In one embodiment, wall 194 and bottom surface 198 are formed of a material that can be stitched. Stitches 256 are placed along the bottom surface 198 and into a surface 148 of product 150 in order to affix the second logo 130 to the product. As shown in FIG. 2, stitches 256 are placed in channel 196 in order to stitch the second logo to the product.

As shown in FIG. 3, the slits 200A, 200B include an alignment feature 270 for guiding ends of the tabs 172A, 172*b* through openings in the slits. By way of example, the alignment features include a slanted or angled wall or surface 260.

In one embodiment, the slits 200A, 200B are formed as the tabs 172A, 172B are pressed against and through the bottom surface 198. For instance, the bottom surface 198 is perforated to form the slits as the tabs are pressed through the bottom surface. In another embodiment, the slits are formed of elastic or resilient material that separates as the tabs are pressed through the bottom surface. When the tabs are removed or not present, an opening through the slits is closed. As such, a user is unable to see through any openings at the slits so underlying product is not visible.

Looking to FIG. 1, the second logo 130 in one embodiment is formed of two of more different materials. For example, logo 160B is formed of a hard, rigid material (such as metal or polymer) and the wall 194 is formed of flexible, stitchable material (such as rubber or an elastomeric material). Further, in one embodiment, the logo 160B is formed of a translucent material to enable light to pass through the logo.

In one embodiment, the second logo 130 is formed of an injection molded rubber material that has an integrated logo molded in a contrasting opaque color. The wall 194 includes an area thin enough to be sewn onto cloth materials. The slits 200A, 200B allow tabs 172A, 172B to penetrate the wall and connect the first and second logos. By way of example, the logo 160A is a metallic logo that is placed over logo 160B if the product warrants a metal looking logo. The metallic logo is made from stamped aluminum or other suitable metals. The aluminum tabs go thru the slits in the second logo and are bent under the product to secure the first and second logos to the product. The aluminum logo does not need stitching or adhesive to secure to the product which saves on cost.

Figure 4:
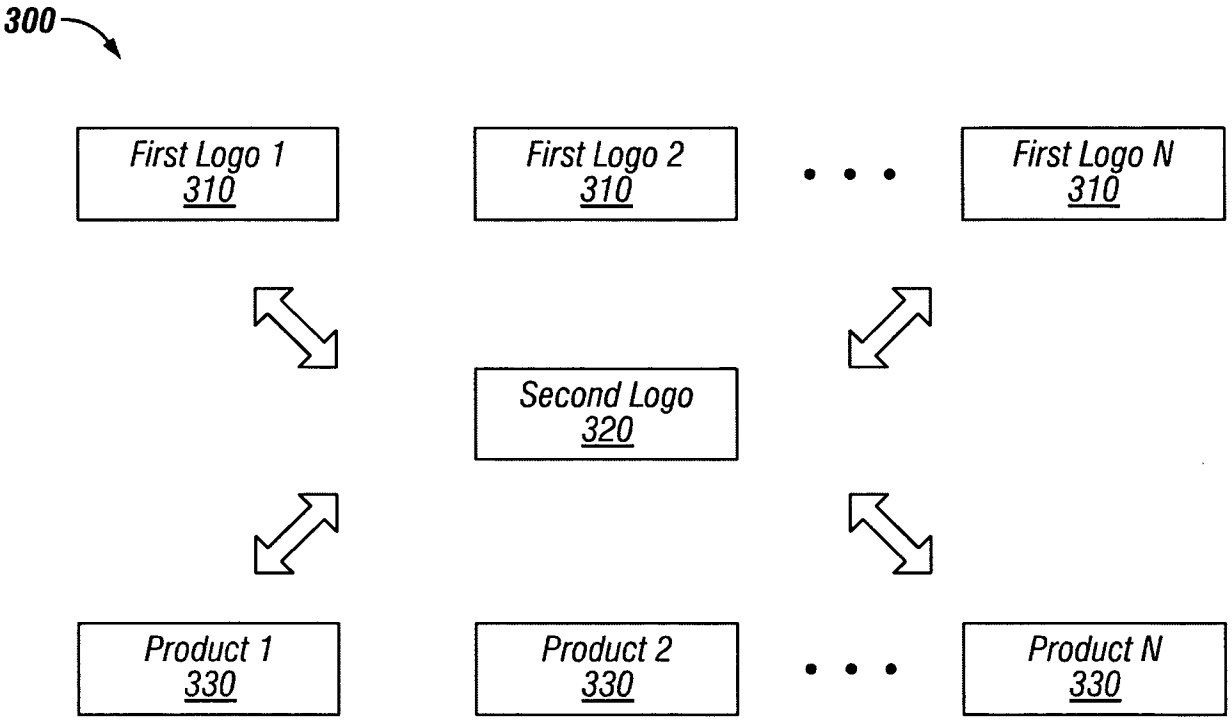
FIG. 4 is a block diagram of a logo system according to one exemplary embodiment.

FIG. 4 is a block diagram of a logo system 300 according to one exemplary embodiment. The logo system includes plural first logos 310 (shown as second logo 1 to second logo N), a second logo 320, and plural products 330 (shown as product 1 to product N).

In one embodiment, the first logos 310 are each different. For example, the first logos include different sizes, shapes, colors, etc. Further, the first logos are each formed of different materials, such a metal, polymer, etc. The products 330 also include different sizes, shapes, colors, etc. Further, the products are each formed of different material (such as cloth, metals, polymers, etc.) and include different surfaces (such a hard flat surfaces and pliable surfaces).

The second logo 320 connects to any one of the plural products 330 using, for example, any one of stitches, adhesive, or other permanent or non-permanent attachments. The second logo can remain permanently or temporary affixed to the product. Then, any one of the first logos 320 can be connected or removed to the second logo and replaced with another of the first logos. For example, the first logo is snap-fit, adhered (example, using adhesive), or connected with tabs to the second logo.

The above discussion is meant to be illustrative of the principles and various embodiments. The terms first, second, bottom, and top are relative. Numerous variations and modifications will become apparent to those skilled in the art once the above disclosure is fully appreciated. It is intended that the following claims be interpreted to embrace all such variations and modifications.

What is claimed is:

1. An apparatus, comprising:

a product having a surface and an opening in the surface;

a first device displaying an indicia and having an opening; and a second device displaying an indicia, the second device removably connected over the first device and being removable from the first device to change from displaying the indicia of the second device on the surface to displaying the indicia of the first device on the surface; and a stiffener having an opening, the product arranged between the first device and the stiffener, wherein the second device has a tab that extends through the opening of the first device, the opening of the product, and the opening of the stiffener, the tab being bendable after passing through the openings of the first device, the product, and the stiffener to secure the first and second devices to the product, and wherein the second device has an underside defining a cavity to receive the first device so the second device covers the indicia of the first device.

2. The apparatus of claim 1, wherein the opening of the first device includes a resilient slit for receiving the tab that extends from the second device, wherein the resilient slit is closed when the tab is not passed through the resilient slit, the surface of the product not being visible through the closed resilient slit.

3. The apparatus of claim 1, wherein the indicia of each of the first and second devices is a company logo, and the first device includes an adhesive for affixing to the product.

4. The apparatus of claim 1, wherein the first device has a flexible periphery that is stitchable for affixing the first device to the surface.

5. The apparatus of claim 1, wherein the second device is rigid and formed of metal and the first device is flexible.

6. The apparatus of claim 1, wherein the opening of the product is a pre-formed opening that is present prior to extension of the tab through the opening of the product.

7. A method, comprising:

affixing a first logo to an object;

providing a second logo that is connectable to and removable from the first logo, wherein the second logo is connectable over the first logo to cause the second logo to be visible on the object and the first logo to be hidden, and wherein the second logo is removable from the first logo to cause the first logo to be visible on the object;

providing a stiffener such that the object is arranged between the stiffener and the first logo; and passing a tab extending from the second logo through an opening of the first logo, an opening of the object, and an opening of the stiffener, the tab being bendable after passing through the openings of the first logo, the object, and the stiffener to secure the first and second logos to the object, wherein the second logo has an underside defining a cavity to receive the first logo so the second logo covers the first logo.

8. The method of claim 7 further comprising stitching the first logo to the object.

9. The method of claim 7 further comprising:

passing another tab extending from the second logo through another opening of the first logo, another opening of the object, and another opening of the stiffener.

10. The method of claim 7 further comprising:

stitching the first logo to cloth, wherein the second logo is formed from metal.

11. The method of claim 7 further comprising:

removing the second logo from the first logo while the first logo remains affixed to the object; and affixing another second logo to the first logo.

12. The method of claim 7, wherein the opening of the object is a pre-formed opening that is present prior to extension of the tab through the opening of the object.

13. The method of claim 7, wherein the opening of the first logo includes a resilient slit for receiving the tab that extends from the second logo, wherein the resilient slit is closed when the tab is not passed through the resilient slit, a surface of the object not being visible through the closed resilient slit.

14. An apparatus, comprising:

a product having a surface and openings in the surface;

a first device displaying first indicia and attached to the surface, the first device having openings; and a second device displaying second indicia and including a body that removably connects to and covers the first indicia, wherein the second device is removable from the first device to change from displaying the second indicia on the surface to displaying the first indicia on the surface; and a stiffener having openings, the product arranged between the first device and the stiffener, wherein the second device has tabs that extend through the respective openings of the first device, the respective openings of the product, and the respective openings of the stiffener, the tabs being bendable after passing through the openings of the first device, the product, and the stiffener to secure the first and second devices to the product, wherein the second device has an underside defining a cavity to receive the first device so the second device covers the first indicia of the first device.

15. The apparatus of claim 14, wherein the second device is formed from aluminum.

16. The apparatus of claim 14, wherein the first device has a flexible portion for receiving stitches for attaching the first device to the surface.

17. The apparatus of claim 14, wherein the first indicia includes a first company logo and the second indicia includes a second company logo different than the first company logo.

18. The apparatus of claim 14, wherein the first indicia is formed of a translucent material and the second indicia is formed of metal.

19. The apparatus of claim 14, wherein the opening of the product is a pre-formed opening that is present prior to extension of the tabs through the openings of the product.

20. The apparatus of claim 14, wherein the openings of the first device include resilient slits for receiving the tabs that extend from the second device, wherein the resilient slits are closed when the tabs are not passed through the resilient slits, the surface of the product not being visible through the closed resilient slits.

* * * * *